US006840214B2

(12) United States Patent
Yasui

(10) Patent No.: US 6,840,214 B2
(45) Date of Patent: Jan. 11, 2005

(54) AIR-FUEL RATIO CONTROL APPARATUS FOR INTERNAL COMBUSTION ENGINE

(75) Inventor: Yuji Yasui, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 16 days.

(21) Appl. No.: 10/600,515

(22) Filed: Jun. 23, 2003

(65) Prior Publication Data

US 2004/0003804 A1 Jan. 8, 2004

(30) Foreign Application Priority Data

Jul. 3, 2002 (JP) ..... 2002-194145

(51) Int. Cl.[7] ..... F02M 7/00
(52) U.S. Cl. ..... 123/344; 123/673
(58) Field of Search ..... 123/344, 402, 123/672, 673, 704

(56) References Cited

U.S. PATENT DOCUMENTS 6,327,850 B1 * 12/2001 Yasui et al. ..... 60/285
6,370,473 B1 * 4/2002 Yasui et al. ..... 701/109

FOREIGN PATENT DOCUMENTS

| | | |
|---|---|---|
| JP | 10-54279 | 2/1998 |
| JP | 11-73206 | 3/1999 |

* cited by examiner

*Primary Examiner*—Bibhu Mohanty
(74) *Attorney, Agent, or Firm*—Squire, Sanders & Dempsey L.L.P.

(57) ABSTRACT

An air-fuel ratio control apparatus for controlling an air-fuel ratio of an air-fuel mixture to be supplied to an internal combustion engine having a plurality of cylinders so that the air-fuel ratio coincides with a target air-fuel ratio. An air-fuel ratio is detected by an air-fuel ratio sensor provided at a position downstream of a joining portion of an exhaust manifold connected to the plurality of cylinders. Model parameters of a controlled object model defined by a relation between an air-fuel ratio detected by the air-fuel ratio sensor and a fuel supply amount parameter that specifies a fuel supply amount to each cylinder of the engine. A degree of differences between air-fuel ratios of air-fuel mixtures to be supplied to the plurality of cylinders is determined according to the identified model parameters.

16 Claims, 8 Drawing Sheets

*FIG. 2*
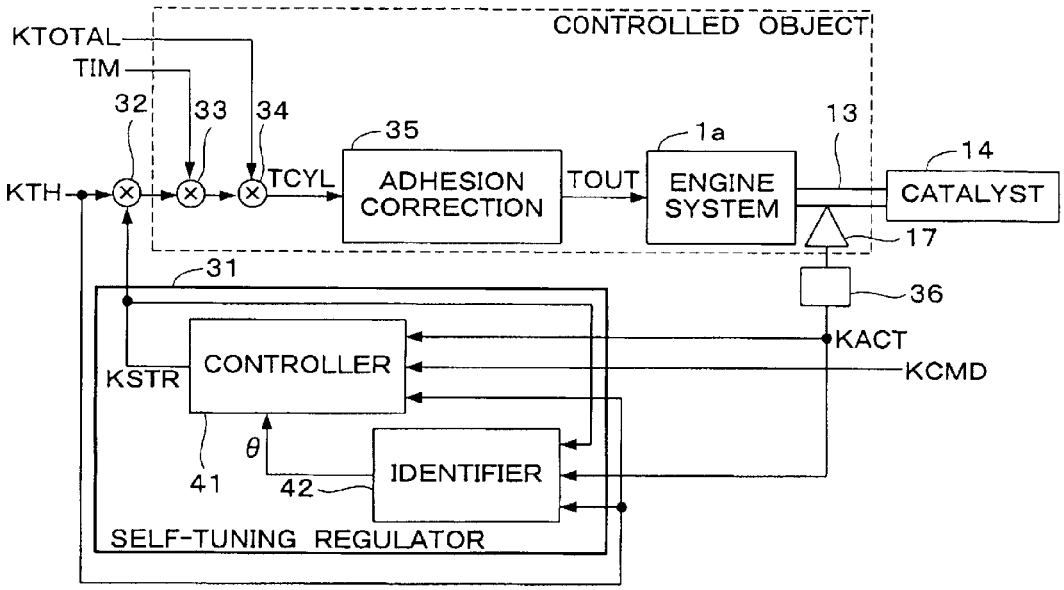
*FIG. 3A* VP
*FIG. 3B* KACT 1.0
*FIG. 3C* KTH 1.0
*FIG. 3D* KSTR 1.0
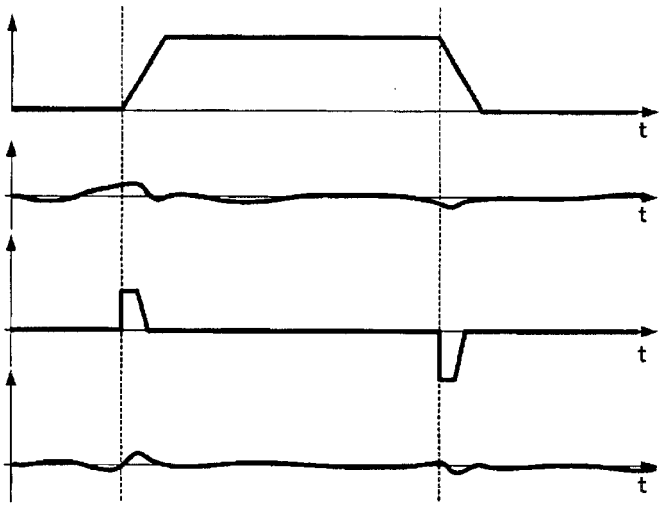

AIR-FUEL RATIO CONTROL APPARATUS FOR INTERNAL COMBUSTION ENGINE

BACKGROUND OF THE INVENTION

Field of the Invention

The present invention relates to an air-fuel ratio control apparatus for an internal combustion engine, and more particularly to an air-fuel ratio control apparatus that controls an air-fuel ratio corresponding to each cylinder of an internal combustion engine having a plurality of cylinders, using a controlled object model obtained by modeling the internal combustion engine.

In an internal combustion engine having a plurality of cylinders, the purifying efficiency of a catalyst provided in an exhaust system of the engine decreases with an increase in air-fuel ratio differences between the plurality of cylinders, causing a deterioration in exhaust characteristics. Therefore, a technique for estimating an air-fuel ratio corresponding to each cylinder and correcting the air-fuel ratio cylinder by cylinder is described in Japanese Patent Laid-open No. Hei 10-54279, for example. According to this publication, a method is shown for estimating an air-fuel ratio corresponding to each cylinder according to an output from a single air-fuel ratio sensor provided at a position downstream of a joining portion of the exhaust manifold connected to cylinders of the engine. More specifically, the air-fuel ratio corresponding to each cylinder is estimated by an observer for observing an internal condition of an exhaust system of the engine according to a model representing the behavior of the exhaust system.

Recently, a self-tuning regulator as described in Japanese Patent Laid-open No. Hei 11-73206, for example, is often used for the air-fuel ratio control of an internal combustion engine. The amount of computation for realizing the self-tuning regulator by a microcomputer is greater compared with a PID (Proportional Integral Derivative) control. Therefore, if the computation for realizing the observer is further necessary, the amount of computation further increases.

Accordingly, it has been desired to provide a method of more simply determining whether the air-fuel ratio differences between a plurality of cylinders has increased.

SUMMARY OF THE INVENTION

It is accordingly a desire of the present invention to provide an air-fuel ratio control apparatus for an internal combustion engine having a plurality of cylinders, which can determine a degree of the air-fuel ratio differences between cylinders with a relatively simple method.

To achieve this desire, one embodiment of the present invention provides An air-fuel ratio control apparatus for controlling an air-fuel ratio of an air-fuel mixture to be supplied to an internal combustion engine having a plurality of cylinders so that the air-fuel ratio (KACT) coincides with a target air-fuel ratio (KCMD). The air-fuel ratio control apparatus in one embodiment includes an air-fuel ratio sensor, identifying component, and air-fuel ratio difference determining means. The air-fuel ratio sensor is provided at a position downstream of a joining portion of an exhaust manifold connected to the plurality of cylinders. The identifying component identifies at least one model parameter (θ) of a controlled object model defined by a relation between an air-fuel ratio (KACT) detected by the air-fuel ratio sensor and a fuel supply amount parameter (KSTR) that specifies a fuel supply amount to each cylinder of the engine. The at least one model parameter (θ) is identified corresponding to each cylinder of the engine. The air-fuel ratio difference determining component determines a degree of differences between air-fuel ratios of air-fuel mixtures to be supplied to the plurality of cylinders according to the at least one model parameter (θ) identified by the identifying component.

With this configuration, at least one model parameter of the controlled object model is identified corresponding to each of the plurality of cylinders, and the air-fuel ratio differences between a plurality of cylinders are determined according to the at least one identified model parameter. Accordingly, the air-fuel ratio differences between a plurality of cylinders can be determined relatively simply without providing an air-fuel ratio sensor for each cylinder, or without performing the computation corresponding to the observer as in the prior art.

Preferably, the air-fuel ratio difference determining component determines the degree of the differences according to the at least one model parameter (θ) identified when a predetermined engine operating condition is satisfied.

With this configuration, the air-fuel ratio differences between cylinders are determined according to the at least one model parameter identified when the predetermined engine operating condition is satisfied. Accordingly, the determination can be accurately performed according to the at least one model parameter identified when the engine operation is stable.

Preferably, the air-fuel ratio difference determining component calculates a difference evaluation parameter (AFOFT) according to the at least one model parameter (θ) and determines the degree of the differences according to a value (AFOFTLS) obtained by a statistical process of the difference evaluation parameter (AFOFT).

With this configuration, the difference evaluation parameter is calculated according to the at least one model parameter, and the determination of the air-fuel ratio differences is performed according to the value obtained by the statistical process of the difference evaluating parameter. Although the at least one identified model parameter indicates variations or fluctuations, the influence of variations or fluctuations can be eliminated by performing the determination according to the value obtained by the statistical process, thereby achieving accurate determination.

Preferably, the statistical process is performed using a sequential algorithm.

With this configuration, the statistical process is performed using a sequential algorithm. Accordingly, it is not necessary to execute the inverse matrix operation and store massive data, to thereby reduce the calculation load on the computing device.

Preferably, the fuel supply amount parameter is a correction coefficient of the fuel supply amount to each cylinder of the engine.

BRIEF DESCRIPTION OF THE DRAWINGS

FIG. 2 is a block diagram showing a part of the control system to illustrate the control by a self-tuning regulator;

FIGS. 3A to 3D are time charts showing control characteristics of the self-tuning regulator in a preferred embodiment;

DETAILED DESCRIPTION OF THE PREFERRED EMBODIMENTS

Preferred embodiments of the present invention will now be described with reference to the drawings.

Figure 1:
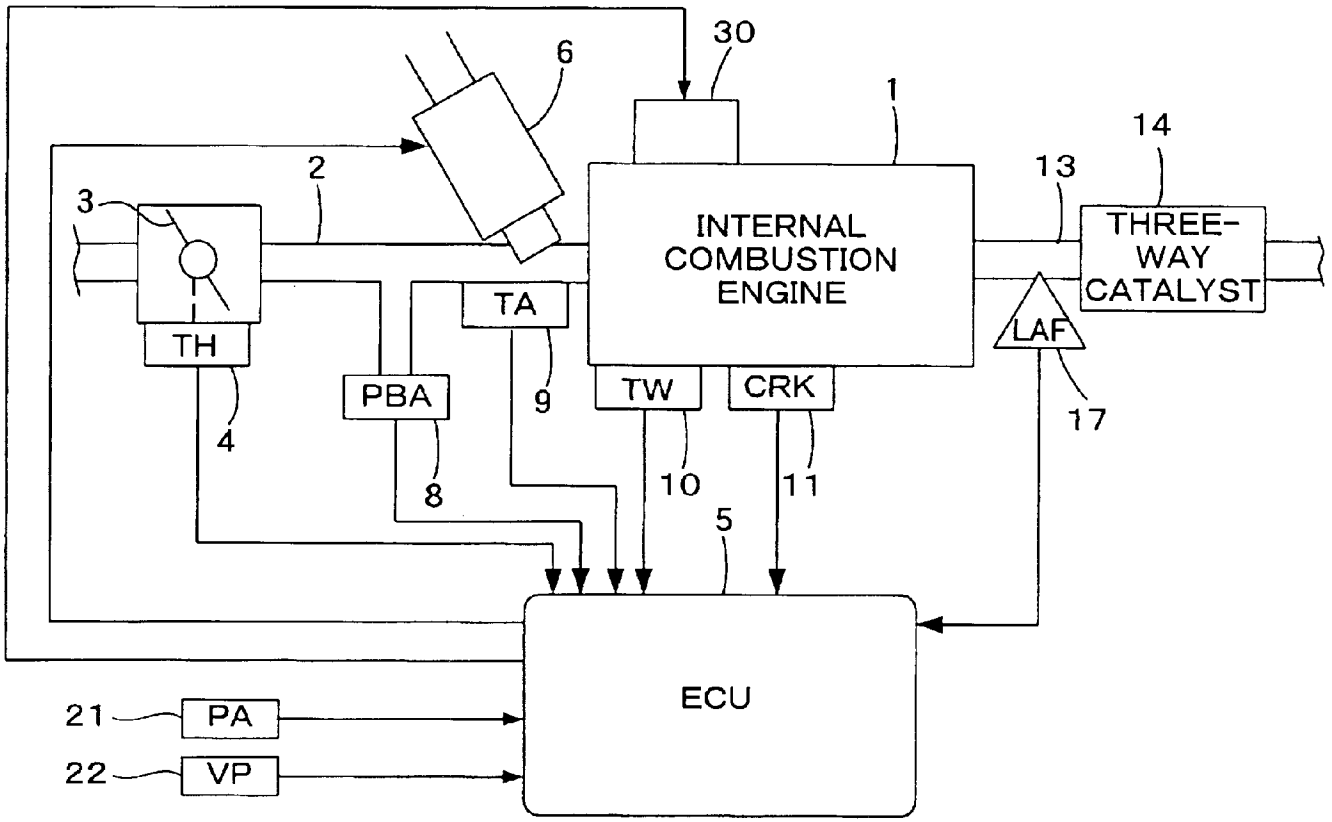
FIG. 1 is a schematic diagram showing a configuration of an internal combustion engine and an air-fuel ratio control apparatus therefore according to a preferred embodiment of the present invention.

FIG. 1 is a schematic diagram showing a configuration of an internal combustion engine (which will be hereinafter referred to as "engine") and an air-fuel ratio control apparatus therefore according to a preferred embodiment of the present invention.

The engine is a four-cylinder engine 1, for example, and it has an intake pipe 2 provided with a throttle valve 3. A throttle angle (TH) sensor 4 is connected to the throttle valve 3, so as to output an electrical signal corresponding to an opening TH of the throttle valve 3 and supply the electrical signal to an electronic control unit (which will be hereinafter referred to as "ECU") 5.

A fuel injection valve 6 is inserted into the intake pipe 2 at a position between the engine 1 and the throttle valve 3 and slightly upstream of an intake valve (not shown) of each cylinder. That is, six fuel injection valves 6 can be respectively provided for the six cylinders of the engine 1. These fuel injection valves 6 are connected to a fuel pump (not shown), and electrically connected to the ECU 5. A valve opening period of each fuel injection valve 6 is controlled by a signal output from the ECU 5.

An absolute intake pressure (PBA) sensor 8 is provided immediately downstream of the throttle valve 3. An absolute pressure signal converted to an electrical signal by the absolute intake pressure sensor 8 is supplied to the ECU 5. An intake air temperature (TA) sensor 9 is provided downstream of the absolute intake pressure sensor 8 to detect an intake air temperature TA. An electrical signal corresponding to the detected intake air temperature TA is output from the sensor 9 and supplied to the ECU 5.

An engine coolant temperature (TW) sensor 10 such as a thermistor is mounted on the body of the engine 1 to detect an engine coolant temperature (cooling water temperature) TW. A temperature signal corresponding to the detected engine coolant temperature TW is output from the engine coolant temperature sensor 10 and supplied to the ECU 5.

A crank angle position sensor 11 for detecting a rotational angle of a crankshaft (not shown) of the engine 1 is connected to the ECU 5, and a signal corresponding to the detected rotational angle of the crankshaft is supplied to the ECU 5. The crank angle position sensor 11 includes a cylinder discrimination sensor to output a pulse at a predetermined crank angle position for a specific cylinder of the engine 1 (this pulse will be hereinafter referred to as a "CYL pulse"). The crank angle position sensor 11 also includes a top dead center (TDC) sensor to output a TDC pulse at a crank angle position before TDC by a predetermined crank angle starting at an intake stroke in each cylinder (e.g., at every 180 deg crank angle in the case of a four-cylinder engine), and a CRK sensor for generating one pulse with a constant crank angle period (e.g., a period of 30 deg) shorter than the period of generation of the TDC pulse (this pulse will be hereinafter referred to as "CRK pulse"). The CYL pulse, the TDC pulse, and the CRK pulse are supplied to the ECU 5. These pulses are used to control the various timings, such as fuel injection timing and ignition timing, and for detection of an engine rotational speed NE.

An exhaust pipe 13 is connected through an exhaust manifold (not shown) to the engine 1. That is, the exhaust manifold in this example has four branched portions respectively connected to the four cylinders of the engine 1, and a joining portion connected to the exhaust pipe 13. The exhaust pipe 13 is provided with an air-fuel ratio sensor (which will be hereinafter referred to as "LAF sensor") 17 for outputting an electrical signal substantially proportional to the oxygen concentration in exhaust gases (which may correspond to the air-fuel ratio of an air-fuel mixture supplied to the engine 1) at a position downstream of the joining portion of the exhaust manifold. A three-way catalyst 14 is provided downstream of the LAF sensor 17. The three-way catalyst 14 reduces HC, CO, and NOx contained in the exhaust gases.

The LAF sensor 17 is connected to the ECU 5 to supply to the ECU 5 an electrical signal substantially proportional to the oxygen concentration in the exhaust gases.

The engine 1 has a valve timing switching mechanism 30 capable of switching the valve timing of intake valves and exhaust valves between a high-speed valve timing suitable for a high-speed rotational region of the engine 1 and a low-speed valve timing suitable for a low-speed rotational region of the engine 1. This switching of the valve timing also includes switching of a valve lift amount. Further, when selecting the low-speed valve timing, one of the two intake valves in each cylinder is stopped to ensure stable combustion when making the air-fuel ratio lean with respect to the stoichiometric ratio.

The valve timing switching mechanism 30 is of such a type that the switching of the valve timing is carried out hydraulically. That is, a solenoid valve for performing the hydraulic switching and an oil pressure sensor are connected to the ECU 5. A detection signal from the oil pressure sensor is supplied to the ECU 5, and the ECU 5 controls the solenoid valve to perform the switching control of the valve timing according to an operating condition of the engine 1.

Although not shown, an exhaust recirculation mechanism and an evaporative fuel processing device may be included. The exhaust recirculation mechanism recirculates the exhaust gases to the intake pipe 2. The evaporative fuel processing device has a canister for storing an evaporative fuel generated in a fuel tank to timely supply the evaporative fuel to the intake pipe 2.

An atmospheric pressure sensor 21 for detecting an atmospheric pressure PA is connected to the ECU 5 to supply a detection signal to the ECU 5. Further, a vehicle speed sensor 22 for detecting a running speed of a vehicle driven by the engine 1, i.e., a vehicle speed VP is also connected to the ECU 5 to supply a detection signal to the ECU 5.

The ECU 5 includes an input circuit, a central processing unit (which will be hereinafter referred to as "CPU"), a memory circuit, and an output circuit. In one example embodiment, the input circuit has various functions including a function of shaping the waveforms of input signals from the various sensors, a function of correcting the voltage levels of the input signals to a predetermined level, and a function of converting analog signal values into digital signal values. The memory circuit may include a ROM (or other suitable memory) preliminarily storing various operational programs to be executed by the CPU and also storing various maps, and a RAM for storing the results of computation or the like by the CPU. The output circuit supplies drive signals to various solenoid valves including the fuel injection valves 6 and spark plugs, for example.

The ECU 5 determines various engine operating conditions such as a feedback control operational region where a feedback control of the air-fuel ratio is performed according to the output from the LAF sensor 17 and an open loop control operational region where an open loop control of the air-fuel ratio is performed, according to the detection signals from the various sensors as mentioned above. The ECU 5 further calculates a required fuel amount TCYL, for example, based on Eq. (1) shown below, according to the engine operating conditions. The required fuel amount TCYL is a fuel amount required for combustion per cycle in each cylinder.

$$TCYL=TIM\times KTH\times KSTR\times KTOTAL \quad (1)$$

TIM is a basic fuel amount, i.e., a basic fuel injection period of each fuel injection valve 6. The basic fuel amount TIM is determined by retrieving a TI map set according to the engine rotational speed NE and the absolute intake pressure PBA. The TI map is set so that the air-fuel ratio of an air-fuel mixture to be supplied to the engine 1 becomes substantially equal to the stoichiometric ratio in an operating condition corresponding to the engine rotational speed NE and the absolute intake pressure PBA on the map. That is, the basic fuel amount TIM preferably has a value substantially proportional to an intake air amount (mass flow) per unit time of the engine 1.

KTH is an acceleration/deceleration correction coefficient set according to a change amount DTH of the throttle opening TH.

KSTR is a self-tuning correction coefficient calculated by a self-tuning regulator to be hereinafter described, according to a detected equivalent ratio KACT and a target equivalent ratio KCMD. The self-tuning correction coefficient KSTR is preferably set so that the detected equivalent ratio KACT coincides with the target equivalent ratio KCMD in the feedback control operational region mentioned above.

KTOTAL is a correction coefficient calculated by multiplying all feed-forward correction coefficients (excluding the acceleration/deceleration correction coefficient KTH) including an engine coolant temperature correction coefficient KTW set according to the engine coolant temperature TW, an intake air temperature correction coefficient KTA set according to the intake air temperature TA, an atmospheric pressure correction coefficient KPA set according to the atmospheric pressure PA, an EGR correction coefficient KEGR set according to an exhaust gas recirculation amount during execution of exhaust gas recirculation, and a purge correction coefficient KPUG set according to a purge fuel amount upon execution of purging by the evaporative fuel processing device.

The ECU 5 further executes an adhesion correction calculation considering the fact that the fuel injected from each fuel injection valve 6 into the intake pipe is partially deposited onto the inner wall of the intake pipe, to thereby calculate a fuel injection period TOUT of each fuel injection valve 6. An example of this adhesion correction is disclosed in detail in Japanese Patent Laid-open No. 8-21273, for example. A fuel amount proportional to the fuel injection period TOUT is injected into the intake pipe 2 by each fuel injection valve 6.

FIG. 2 is a block diagram showing part of a control system for illustrating a control by the self-tuning regulator. The control system shown in FIG. 2 consists of a self-tuning regulator 31, multipliers 32, 33, and 34, an adhesion correction section 35, an engine system 1*a*, the exhaust pipe 13, the LAF sensor 17, and a converting section 36. The engine system 1*a* includes the fuel injection valves 6, the intake pipe 2, and the engine 1. The self-tuning regulator 31, the multipliers 32 to 34, the adhesion correction section 35, and the converting section 36 are actually realized by the calculation process to be executed by the CPU of the ECU 5.

The converting section 36 converts an output from the LAF sensor 17 into the detected equivalent ratio KACT. The self-tuning regulator 31 preferably includes a controller 41 and an identifier 42. The identifier 42 calculates a model parameter vector θ according to the detected equivalent ratio KACT, the self-tuning correction coefficient KSTR, and the acceleration/deceleration correction coefficient KTH. The model parameter vector is a vector having a plurality of model parameters as elements defining a controlled object model to be hereinafter described. In one embodiment, the controller 41 calculates the self-tuning correction coefficient KSTR with an inverse transfer function of a transfer function of the controlled object model, using the model parameter vector θ, according to past values of the target equivalent ratio KCMD, the detected equivalent ratio KACT, the self-tuning correction coefficient KSTR, and the acceleration/deceleration correction coefficient KTH.

The multipliers 32 to 34 execute the calculaltion of Eq. (1) to obtain the required fuel amount TCYL. The adhesion correction section 35 performs adhesion correction process to calculate the fuel injection period TOUT.

In an example of this embodiment, the controlled object model is defined by Eq. (2) shown below.

$$\begin{aligned} KACT(k) = {} & b0\times KSTR(k-3)\times KTH(k-3) + \\ & r1\times KSTR(k-4)\times KTH(k-4) + \\ & r2\times KSTR(k-5)\times KTH(k-5) + \\ & r3\times KSTR(k-6)\times KTH(k-6) + s0\times KACT(k-3) \end{aligned} \quad (2)$$

where b0, r1, r2, r3, and s0 are the model parameters identified by the identifier 42, and k indicates a control time (sampling time) corresponding to the combustion cycle in a specific cylinder, i.e., the control time corresponding to a crank angle period of 720 deg.

Assuming that a model parameter vector θ(k) having the model parameters as elements is defined by Eq. (3) shown below, the model parameter vector θ(k) is calculated from Eq. (4) shown below.

$$\theta(k)^T=[b0,\ r1,\ r2,\ r3,\ s0] \quad (3)$$

$$\theta(k)=\theta(k-1)+KP(k)ide(k) \quad (4)$$

where KP(k) is a gain coefficient vector defined by Eq. (5) shown below. In Eq. (5), P(k) is a fifth-order square matrix defined by Eq. (6) shown below, and ide(k) is an identification error defined by Eq. (7) shown below. In Eq. (7), KACTHAT(k) is an estimated equivalent ratio calculated from Eq. (8), using a latest model parameter vector θ(k−1). In Eqs. (5), (6), and (8), ζ (k) is the vector defined by Eq. (9) shown below and having the control output (KACT) and the control input (KSTR×KTH) as elements.

$$KP(k) = \frac{P(k)\zeta(k)}{1+\zeta^T(k)P(k)\zeta(k)} \quad (5)$$

$$P(k+1) = \frac{1}{\lambda_1}\left(E - \frac{\lambda_2(K)\zeta(k)\zeta^T(k)}{\lambda_1+\lambda_2\zeta^T(k)P(k)\zeta(k)}\right)P(k) \quad (6)$$

($E$: the unit matrix)

$$ide(k)=KACT(k)-KACTHAT(k) \quad (7)$$

$$KACTHAT(k)=\theta(k-1)T\zeta(k) \quad (8)$$

$$\zeta(k)^T = [KSTR(k-3)\times KTH(k-3), KSTR(k-4)\times KTH(k-4), KSTR(k-5)\times KTH(k-5), KSTR(k-6)\times KTH(k-6), KACT(k-3)] \quad (9)$$

According to settings of the coefficients λ1 and λ2 in Eq. (6), the identification algorithm by Eqs. (4) to (9) is classified into the following four identification algorithms.

For λ1=1 and λ2=0, fixed gain algorithm

For λ1=1 and λ2=1, least square method algorithm

For λ1=1 and λ2=λ, decreasing gain algorithm (λ takes any predetermined values other than "0" and "1")

For λ1=λ and λ2=1, weighted least square method algorithm (λ takes any predetermined values other than "0" and "1")

The vector ζ defined by Eq. (9) has the control input (KSTR×KTH) as elements obtained by multiplying the self-tuning correction coefficient KSTR by the acceleration/deceleration correction coefficient KTH at the respective times. Accordingly, even when the air-fuel ratio of an air-fuel mixture to be supplied to the engine 1 is excessively corrected by the acceleration/deceleration correction coefficient KTH and this excessive correction appears in the detected equivalent ratio KACT, the identifier 42 can recognize that the appearance of this excessive correction is due to a change in the control input (KSTR×KTH) to the controlled object (see FIG. 2). Therefore, the identifier 42 may not perform an operation for modifying this excessive correction of the air-fuel ratio (detected equivalent ratio KACT). As a result, it is possible to prevent any inconvenience due to the introduction of the acceleration/deceleration correction coefficient KTH into the air-fuel ratio control using the self-tuning regulator.

The controller 41, in one embodiment, calculates the self-tuning correction coefficient KSTR(k) from Eq. (10) shown below.

$$KSTR(k) = (1/b0)[KCMD(k) - r1\times KSTR(k-1)\times KTH(k-1) - r2\times KSTR(k-2)\times KTH(k-2) - r3\times KSTR(k-3)\times KTH(k-3) - s0\times KACT(k)] \quad (10)$$

FIGS. 3A to 3D are time charts showing changes in the detected equivalent ratio KACT and in the self-tuning correction coefficient KSTR at acceleration and deceleration of the vehicle driven by the engine 1. FIG. 3A shows changes in the vehicle speed VP. In this embodiment, the self-tuning correction coefficient KSTR does not largely change when executing the air-fuel ratio correction toward a rich region and a lean region by the acceleration/deceleration correction coefficient KTH (see FIGS. 3C and 3D). Accordingly, the detected equivalent ratio KACT does not largely change when the acceleration/deceleration correction coefficient KTH is returned to "1.0" (see FIG. 3B), so that good air-fuel ratio control characteristics can be obtained.

In the case of adopting the fixed gain algorithm wherein the coefficient λ1 is set to "1" and the coefficient λ2 is set to "0" in Eq. (6), Eq. (5a) shown below is used in place of Eq. (5). In Eq. (5a), P is a diagonal matrix wherein the diagonal elements are constants.

$$KP(k) = \frac{P\zeta(k)}{1+\zeta^T(k)P\zeta(k)} \quad (5a)$$

Further, Eq. (4a) shown below may be used in place of Eq. (4) to calculate the model parameter vector θ in order to prevent a drift of the model parameters to be identified.

$$\theta(k)=SGM\theta(k-1)+KP(k)ide(k) \quad (4a)$$

where SGM is a forgetting coefficient matrix defined by Eq. (11). The diagonal elements of the forgetting coefficient matrix SGM are set to "1" or a forgetting coefficient σ and all the other elements are set to "0". The forgetting coefficient σ is set to a value between "0" and "1", and has a function of reducing an influence of past values of the identification error.

$$SGM = \begin{bmatrix} 1 & 0 & 0 & 0 & 0 \\ 0 & \sigma & 0 & 0 & 0 \\ 0 & 0 & \sigma & 0 & 0 \\ 0 & 0 & 0 & \sigma & 0 \\ 0 & 0 & 0 & 0 & \sigma \end{bmatrix} \quad (11)$$

There will now be described a method of determining a degree of air-fuel ratio differences between cylinders in accordance with one embodiment of the present invention.

The identifier 42 sequentially identifies the model parameters of the controlled object model defined by Eq. (2) (shown below again). The control time k in this model is a control time which is synchronous with the combustion cycle in a specific cylinder. Therefore, Eq. (2) defines the controlled object model by the relation between the control input (KSTR×KTH) and the control output (KACT) corresponding to each cylinder.

$$KACT(k) = b0\times KSTR(k-3)\times KTH(k-3) + r1\times KSTR(k-4)\times KTH(k-4) + r2\times KSTR(k-5)\times KTH(k-5) + r3\times KSTR(k-6)\times KTH(k-6) + s0\times KACT(k-3) \quad (2)$$

In the above controlled object model, when the detected equivalent ratio (control output) KACT and the self-tuning correction coefficient KSTR in a steady state are expressed as constant values KACT' and KSTR', respectively, Eq. (12) shown below holds because the acceleration/deceleration correction coefficient KTH in the steady state equals "1.0".

$$KACT'=b0\times KSTR'+r1\times KSTR'+r2\times KSTR'+r3\times KSTR'+s0\times KACT' \quad (12)$$

Eq. (12) is transformed into Eq. (13) shown below.

$$KACT' = \frac{b0+r1+r2+r3}{1-s0}KSTR' \quad (13)$$

The coefficient [(b0+r1+r2+r3)/(1−s0)] of KSTR' on the right side of Eq. (13) indicates a ratio between an input to the engine 1 and an output from the engine 1, i.e., a steady air-fuel ratio deviation in each cylinder. Accordingly, the model parameter vector θ corresponding to each cylinder is expressed, by way of example, in Eq. (14) shown below, and the coefficient of KSTR' mentioned above is expressed as a steady-state correction coefficient AFOFT by Eq. (15) shown below.

$$\theta(k,i)^T=[b0(k,i), r1(k,i), r2(k,i), r3(k,i), s0(k,i)] \quad (14)$$

$$AFOFT(k, i) = \frac{b0(k, i) + r1(k, i) + r2(k, i) + r3(k, i)}{1 - s0(k, i)} \quad (15)$$

In Eqs. (14) and (15), i is a cylinder specifying parameter, which takes values from "0" to "3", and i=0, 1, 2, and 3 respectively correspond to #1 cylinder, #3 cylinder, #4 cylinder, and #2 cylinder.

When the steady-state correction coefficient AFOFT(k,i) is "1.0", it indicates that no air-fuel ratio deviation is present. If there occurs a failure or aged deterioration (which will be hereinafter referred to simply as "abnormality") in the fuel injection valves 6, the exhaust gas recirculating mechanism, the evaporative fuel processing device, etc., a deviation of the steady-state correction coefficient AFOFT(k,i) from "1.0" becomes greater. Accordingly, the steady-state correction coefficient AFOFT(k,i) may be used as a parameter indicating a degree of air-fuel ratio differences between cylinders.

In this embodiment, data of the steady-state correction coefficient AFOFT(k,i) obtained when a predetermined engine operating condition is satisfied, are first subjected to a statistical process to thereby calculate an air-fuel ratio deviation AFOFTLS(k,i), and an average value AFOFTAVE is next calculated by averaging values of the air-fuel ratio deviation AFOFTLS(k,i) of all the cylinders is next calculated. Further, when the absolute value of the difference between the steady-state correction coefficient AFOFT(k,i) indicative of the air-fuel ratio deviation of each cylinder and the average value AFOFTAVE is greater than a predetermined determination threshold AFOFTLMT, it is determined that a degree of the air-fuel ratio differences between cylinders are large, that is, it is determined that an abnormality is present. The predetermined engine operating condition is satisfied when all of the engine rotational speed NE, the absolute intake pressure PBA, the engine coolant temperature TW, the intake air temperature TA, and the vehicle speed VP fall within predetermined ranges.

In general, a least square method is known as a method of statistical process. However, the statistical process by the least square method is performed usually by storing all of the data within a given period, i.e., all of the values of the steady-state correction coefficient AFOFT(k,i) within a given period in a memory, and subsequently executing a batch operation at a certain timing. In this batch operation, however, the memory is required to have a large storing capacity for storing all of the data, and an inverse matrix operation is required, which causes an increase in the calculation amount of the CPU.

In this embodiment, a sequential least square method algorithm which is applied to the identifying calculation by the identifier 42 mentioned above is applied also to this statistical process to calculate a central value of the least squares of the steady-state correction coefficient AFOFT(k,i) as the air-fuel ratio deviation AFOFTLS(k,i).

More specifically, this statistical process is performed by the sequential least square method algorithm using Eqs. (16), (17), and (18) shown below.

$$AFOFTLS(k,i)=AFOFT(k-1,i)+KQ(k)[AFOFT(k,i)-AFOFTLS(k-1, i)] \quad (16)$$

$$KQ(k) = \frac{Q(k)}{1 + Q(k)} \quad (17)$$

$$Q(k+1) = \frac{1}{\lambda_1'}\left(1 - \frac{\lambda_2' Q(k)}{\lambda_1' + \lambda_2 Q(k)}\right)Q(k) \quad (18)$$

The coefficient KQ(k) calculated from Eq. (17) corresponds to the gain coefficient vector KP(k) calculated from Eq. (5), and the gain parameter Q(k) used for calculation of the gain coefficient KQ(k) is calculated from the recurrence formula of Eq. (18).

λ1' and λ2' are coefficients respectively corresponding to the coefficients λ1 and λ2 in Eq. (6). According to the setting of these coefficients λ1' and λ2', the statistical process algorithm by Eqs. (16) to (18) becomes any one of the fixed gain algorithm, the least square method algorithm, the decreasing gain algorithm, and the weighted least square method algorithm.

When the predetermined engine operating condition mentioned above is not satisfied, Eqs. (16a) and (18a) are used to retain preceding values.

$$AFOFTLS(k,i)=AFOFTLS(k-1, i) \quad (16a)$$

$$Q(k+1)=Q(k) \quad (18a)$$

Thereafter, the average value AFOFTAVE is calculated from Eq. (19) shown below.

$$AFOFTAVE = \frac{\sum_{i=0}^{m} AFOFTLS(k, i)}{m + 1} \quad (19)$$

where (m+1) stands for the number of cylinders, which is "4" in this embodiment.

When Eq. (20) shown below holds, it is determined that air-fuel ratio differences between cylinders are small (normal), while when Eq. (21) shown below holds, it is determined that air-fuel ratio differences between cylinders are large (abnormal) so that the purification efficiency of the catalyst 14 is reduced.

$$|AFOFTLS(k,i)-AFOFTAVE|<AFOFTLMT \quad (20)$$

$$|AFOFTLS(k,i)-AFOFTAVE|\geqq AFOFTLMT \quad (21)$$

where AFOFTLMT is a predetermined determination threshold, which is set to 0.1, for example.

According to the above-mentioned method of determining air-fuel ratio differences between cylinders, it is not necessary to provide an air-fuel ratio sensor corresponding to each cylinder, and the determination can be performed more simply as compared with the conventional method employing the observer.

An example of the calculation process for the acceleration/deceleration correction coefficient KTH and the self-tuning correction coefficient KSTR, and the determination process for a degree of the air-fuel ratio differences between cylinders will now be described with reference to FIGS. 4 to 11. The following processes may, for example, be executed by the CPU of the ECU 5.

Figure 4:
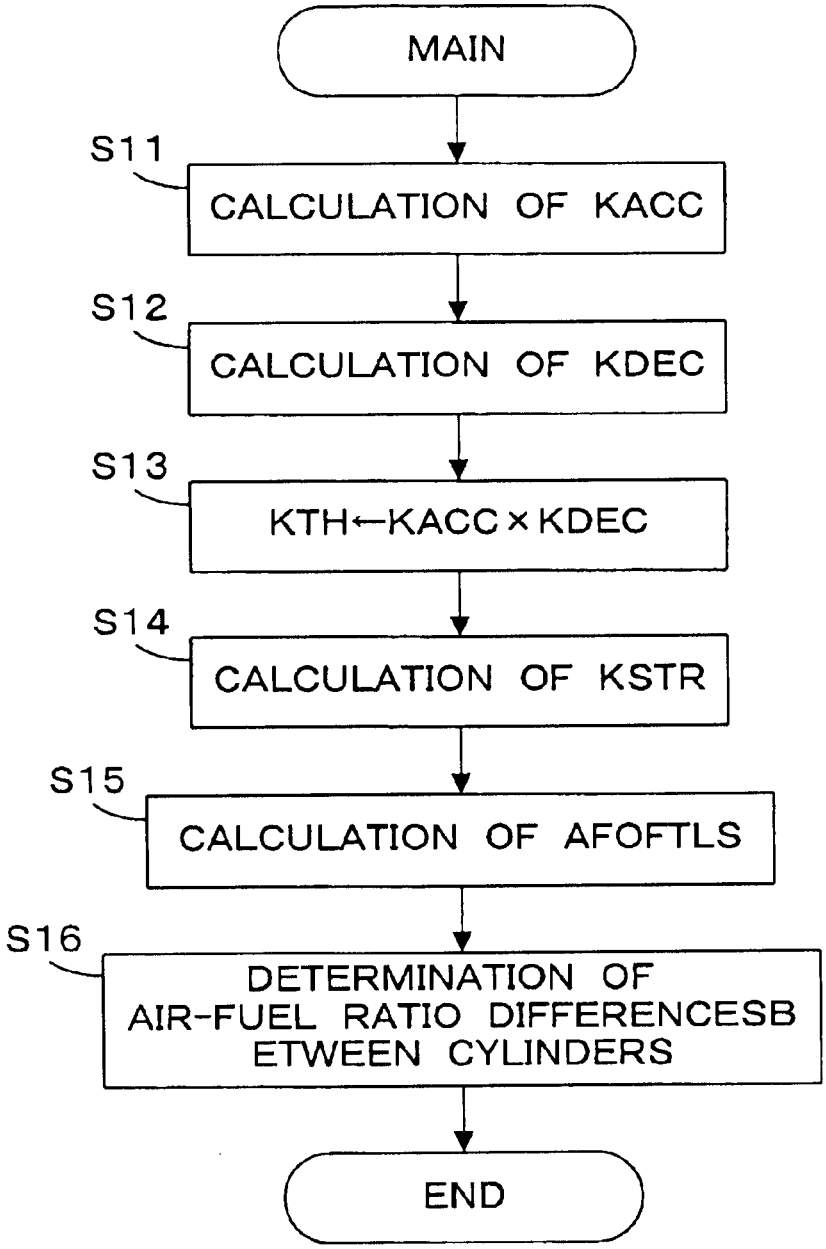
FIG. 4 is a flowchart showing a part of a main routine for calculating a required fuel amount (TCYL)

FIG. 4 is a flowchart showing an essential part of a main routine for calculating the required fuel amount TCYL. This process is preferably executed in synchronism with the generation of a TDC pulse by the CPU of the ECU 5.

Figure 5:
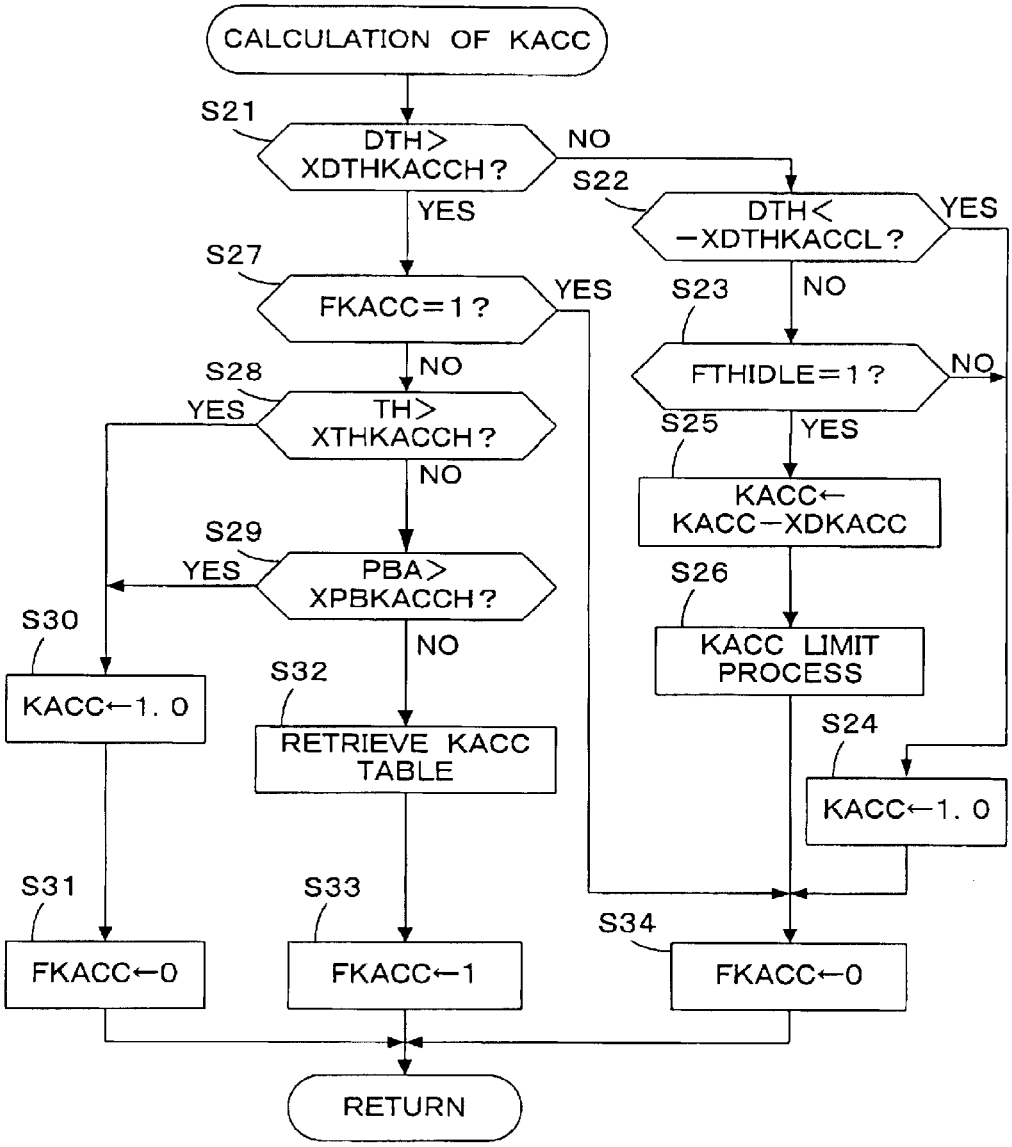
FIG. 5 is a flowchart showing a program for calculating an acceleration correction coefficient (KACC)
Figure 6:
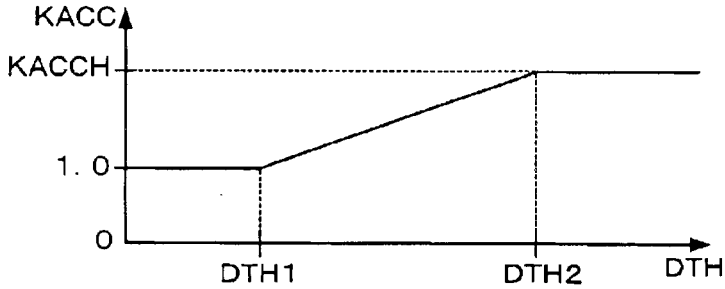
FIG. 6 is a graph showing a table used in the process of FIG. 5.
Figure 7:
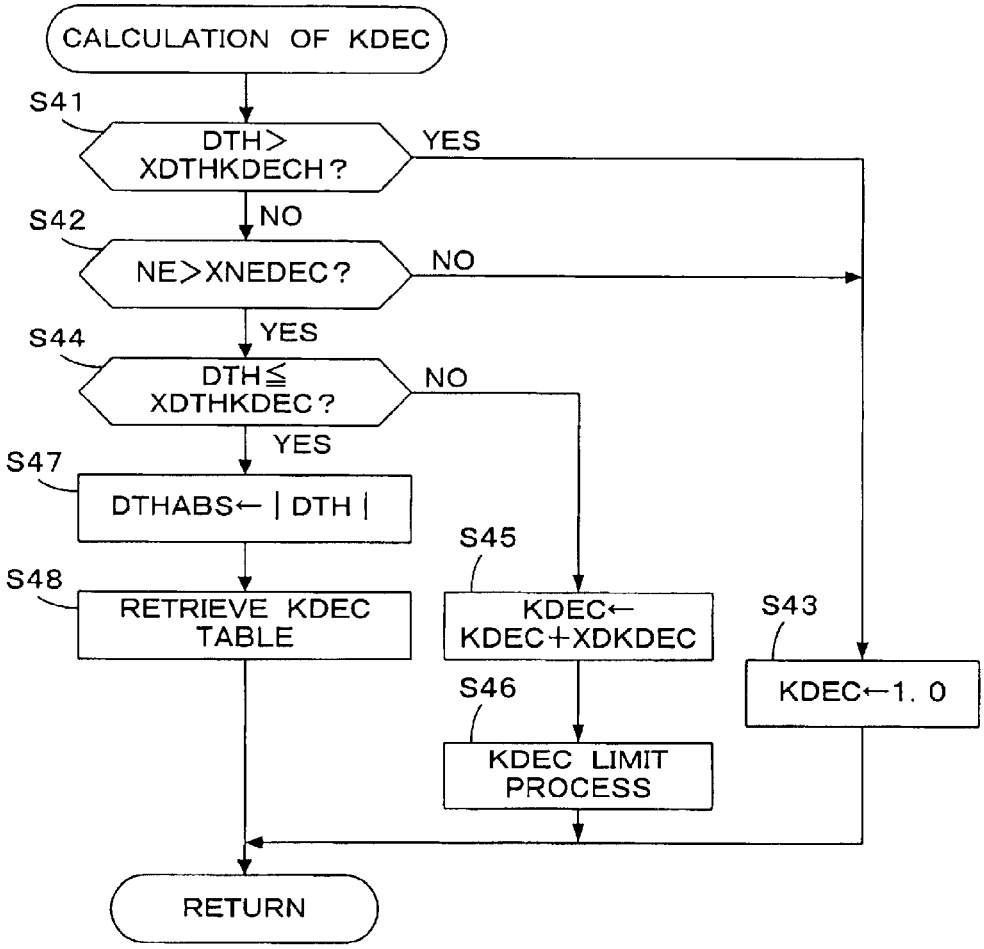
FIG. 7 is a flowchart showing a program for calculating a deceleration correction coefficient (KDEC)

In step S11, a KACC calculation process shown in FIG. 5 is executed to calculate an acceleration correction coefficient KACC. In step S12, a KDEC calculation process shown in FIG. 7 is executed to calculate a deceleration correction coefficient KDEC. In step S13, the acceleration/deceleration correction coefficient KTH is calculated, e.g., using Eq. (22) shown below.

$$KTH=KACC\times KDEC \quad (22)$$

Figure 9:
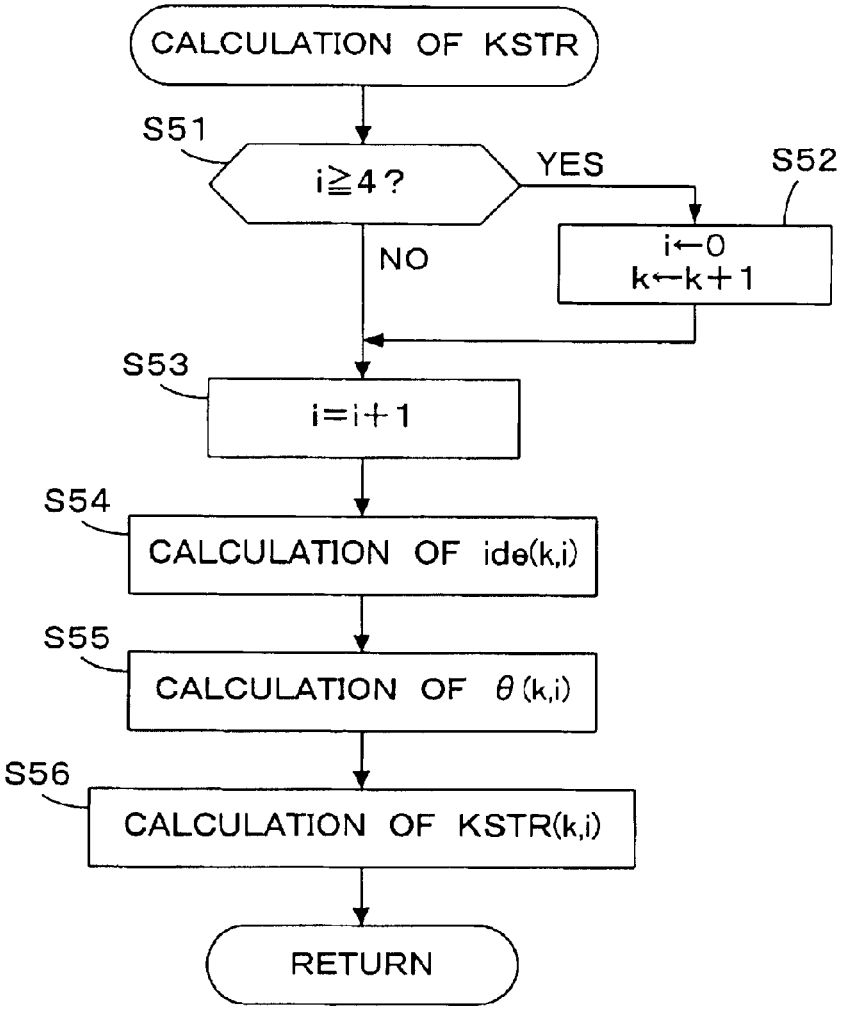
FIG. 9 is a flowchart showing a program for calculating a self-tuning correction coefficient (KSTR)

In step S14, a KSTR calculation process shown in FIG. 9 is executed to calculate the self-tuning correction coefficient KSTR.

The acceleration/deceleration correction coefficient KTH calculated in step S13 and the self-tuning correction coefficient KSTR calculated in step S14 are applied to Eq. (1) together with the basic fuel amount TIM and the correction coefficient KTOTAL. The basic fuel amount TIM and the correction coefficient KTOTAL are calculated by the processes not shown. Accordingly, the required fuel amount (TCYL) is calculated by Eq. (1).

Figure 10:
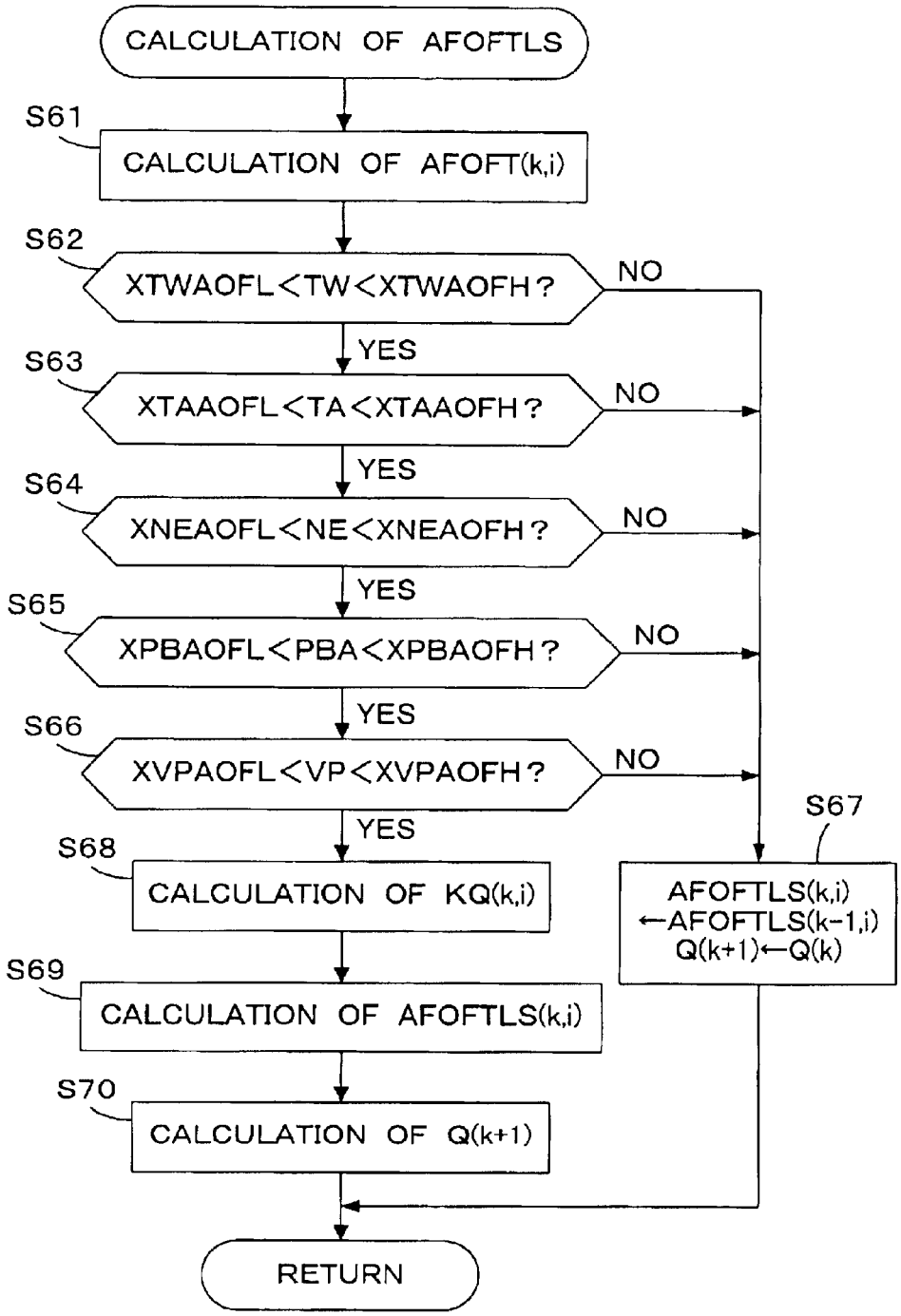
FIG. 10 is a flowchart showing a program for calculating a steady-state correction coefficient (AFOFT)

In step S15, an AFOFTLS calculation process, an example of which is shown and described with reference to FIG. 10, is executed to calculate the air-fuel ratio deviation AFOFTLS.

Figure 11:
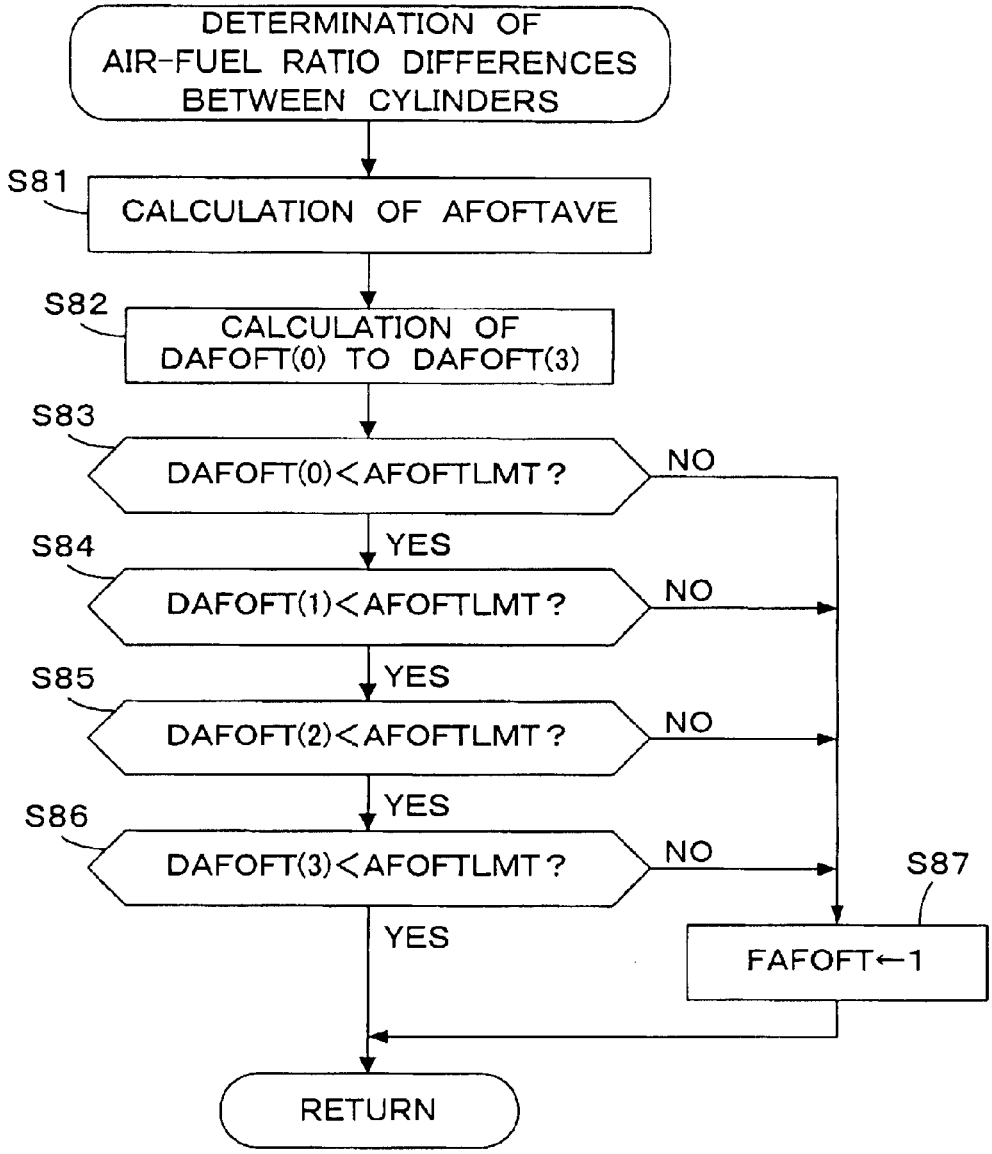
FIG. 11 is a flowchart showing a program for determining air-fuel ratio variations in each cylinder.

In step S16, the determination process of a degree of the air-fuel ratio differences between cylinders shown in FIG. 11 is executed. In this process, when it is determined that an abnormality such that a degree of the air-fuel ratio differences between cylinders becomes large, has occurred, a warning lamp for warning the driver of the vehicle is turned on.

FIG. 5 is a flowchart showing the KACC calculation process executed in step S11 shown in FIG. 4.

In step S21, it is determined whether or not the change amount DTH[=TH(n)−TH(n−1) where n is a control time corresponding to the control period (crank angle of 180 deg) in this process] of the throttle opening TH is greater than an acceleration determination threshold XDTHKACCH (e.g., 1.8 deg). If DTH is greater than XDTHKACCH, it is determined whether or not an acceleration start flag FKACC is "1" (step S27). The acceleration start flag FKACC is set to "1" when it is determined that rapid acceleration of the vehicle driven by the engine 1 has been started (step S33).

If FKACC is "0" in step S27, it is determined whether or not the throttle opening TH is greater than a predetermined opening XTHKACCH (e.g., 35 deg) (step S28). The answer to step S28 is negative (NO) at the initial stage of the acceleration. Accordingly, the program proceeds to step S29 to determine whether or not the absolute intake pressure PBA is higher than a predetermined intake pressure XPBKACCH (e.g., 73 kPa (550 mmHg)). The answer to step S29 is also negative (NO) at the initial stage of the acceleration. Accordingly, the program proceeds to step S32 to retrieve a KACC table shown in FIG. 6 according to the throttle opening change amount DTH, and to thereby calculate the acceleration correction coefficient KACC. According to the KACC table, the acceleration correction coefficient KACC increases with an increase in the throttle opening change amount DTH, when the throttle opening change amount DTH falls between a first set value DTH1 and a second set value DTH2. When the throttle opening change amount DTH is less than the first set value DTH1, the acceleration correction coefficient KACC is set to "1.0", while when the change amount DTH is greater than the second set value DTH2, the coefficient KACC is set to a maximum value KACCH.

In step S33, the acceleration start flag FKACC is set to "1". When the acceleration start flag FKACC is set to "1", the program proceeds from step S27 to step S34 in the next execution of this process to return the acceleration start flag FKACC to "0".

If the acceleration start flag FKACC is "0" and the throttle opening TH is greater than the predetermined opening XTHKACCH, or if the acceleration start flag FKACC is "0" and the absolute intake pressure PBA is higher than the predetermined intake pressure XPBKACCH, the program proceeds to step S30 to set the acceleration correction coefficient KACC to "1.0". Thereafter the acceleration start flag FKACC is set to "0" (step S31).

If DTH is less than or equal to XDTHKACCH in step S21, it is determined whether or not the throttle opening change amount DTH is less than a negative predetermined change amount−XDTHKACCL (e.g., −0.3 deg) (step S22). If DTH is greater than or equal to −XDTHKACCL, it is determined whether or not a throttle full-closure flag FTHIDLE is "1" (step S23).

If DTH is less than −XDTHKACCL, which indicates that the throttle valve 3 is rapidly closed, or if FTHIDLE is "0", which indicates that the throttle valve 3 is fully closed, the acceleration correction coefficient KACC is set to "1.0" (step S24), and the program next proceeds to step S34. If FTHIDLE is "1" (the throttle valve 3 is not fully closed), the acceleration correction coefficient KACC is decremented by a predetermined amount XDKACC (e.g., 0.01) (step S25), and a limit process is next performed so that the minimum value of the acceleration correction coefficient KACC becomes "1.0" (step S26). In this limit process, it is determined whether or not the acceleration correction coefficient KACC is less than "1.0", and if KACC is less than "1.0", the acceleration correction coefficient KACC is set to "1.0".

FIG. 7 is a flowchart showing the KDEC calculation process executed in step S12 shown in FIG. 4.

In step S41, it is determined whether or not the throttle opening change amount DTH is greater than a positive predetermined change amount XDTHKDECH (e.g., 0.1 deg). If DTH is less than or equal to XDTHKDECH, it is determined whether or not the engine rotational speed NE is higher than a predetermined rotational speed XNEDEC (e.g., 1300 rpm) (step S42). If DTH is greater than XDTHKDECH, or NE is less than or equal to XNEDEC, the deceleration correction coefficient KDEC is set to "1.0" (step S43).

Figure 8:
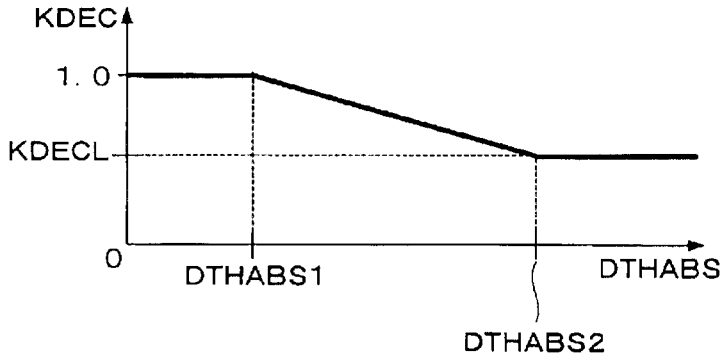
FIG. 8 is a graph showing a table used in the process of FIG. 7.

If NE is greater than XNEDEC, it is determined whether or not the throttle opening change amount DTH is less than or equal to a negative deceleration determination threshold XDTHKDEC (e.g., −0.8 deg) (step S44). If DTH is less than or equal to XDTHKDEC, which indicates that the valve closing speed of the throttle valve 3 is high, the absolute value of the throttle opening change amount DTH is stored as an absolute change amount DTHABS (step S47). Thereafter, a KDEC table, such as that shown in FIG. 8, is retrieved according to the absolute change amount DTHABS to calculate the deceleration correction coefficient KDEC (step S48). According to the KDEC table, the deceleration correction coefficient KDEC decreases with an increase in the absolute change amount DTHABS, when the absolute change amount DTHABS falls between a first set value DTHABS1 and a second set value DTHABS2. When the absolute change amount DTHABS is less than the first set value DTHABS1, the deceleration correction coefficient KDEC is set to "1.0". When the change amount DTHABS is greater than the second set value DTHABS2, the coefficient KDEC is set to a minimum value KDECL.

If DTH is greater than XDTHKDEC in step S44, the deceleration correction coefficient KDEC is incremented by a predetermined amount XDKDEC (e.g., 0.01) (step S45), and a limit process is next performed so that the maximum value of the deceleration correction coefficient KDEC becomes "1.0" (step S46). In this limit process, it is determined whether or not the deceleration correction coefficient KDEC is greater than "1.0", and if KDEC is greater than 1.0, the deceleration correction KDEC is set to "1.0".

FIG. 9 is a flowchart showing an example KSTR calculation process executed in step S14 shown in FIG. 4.

In step S51, it is determined whether or not the cylinder specifying parameter i is greater than or equal to "4". If i is less than "4", the program proceeds directly to step S53. If i is greater than or equal to "4", the cylinder specifying parameter i is reset to "0" and the control time k is incremented by "1" (step S52). Thereafter, the program proceeds to step S53.

The cylinder specifying parameter i takes values of "0" to "3", and i=0, 1, 2, and 3 respectively correspond to #1 cylinder, #3 cylinder, #4 cylinder, and #2 cylinder. The control time k is a time corresponding to the combustion cycle (crank angle period of 720 deg) of a specific cylinder (e.g., #1 cylinder). Therefore, the cylinder specifying parameter i is introduced in order to calculate the model parameter vector θ and the self-tuning correction coefficient KSTR corresponding to each cylinder.

In step S53, the cylinder specifying parameter i is incremented by "1". Thereafter, the identification error ide(k,i) is calculated from Eqs. (27), (28), and (29) shown below (step s54). Thereafter, the model parameter vector θ(k,i) is calculated from Eqs. (23) to (26) shown below (step s55). Eqs. (23) to (29) are obtained by changing the control time indicating parameter (k) in Eqs. (3) to (9) into a control time indicating parameter (k,i) including of the control time k and the cylinder specifying parameter i.

$$\theta(k,i)^T=[b0(k,i),\ r1(k,i),\ r2(k,i),\ r3(k,i),\ s0(k,i)] \tag{23}$$

$$\theta(k,i)=\theta(k-1,i)+KP(k,i)ide(k,i) \tag{24}$$

$$KP(k,i)=\frac{P(k,i)\zeta(k,i)}{1+\zeta^T(k,i)P(k,i)\zeta(k,i)} \tag{25}$$

$$P(k+1,i)=\frac{1}{\lambda_1}\left(E-\frac{\lambda_2 P(k,i)\zeta(k,i)\zeta^T(k,i)}{\lambda_1+\lambda_2\zeta^T(k,i)P(k,i)\zeta(k,i)}\right)P(k,i) \tag{26}$$

($E$: the unit matrix)

(E: the unit matrix)

$$ide(k,i)=KACT(k,i)-KACTHAT(k,i) \tag{27}$$

$$KACTHAT(k,i)=\theta(k-1,i)^T\zeta(k,i) \tag{28}$$

$$\begin{aligned}\zeta(k,i)^T=[&KSTR(k-3,i)\times KTH(k-3,i),\\ &KSTR(k-4,i)\times KTH(k-4,i),\\ &KSTR(k-5,i)\times KTH(k-5,i),\\ &KSTR(k-6,i)\times KTH(k-6,i),\\ &KACT(k-3,i)]\end{aligned} \tag{29}$$

In step S56, the self-tuning correction coefficient KSTR (k,i) is calculated from Eq. (30) shown below.

$$\begin{aligned}KSTR(k,i)=[1/b0(k,i)][&KCMD(k,i)-\\ &r1(k,i)\times KSTR(k-1,i)\times KTH(k-1,i)-\\ &r2(k,i)\times KSTR(k-2,i)\times KTH(k-2,i)-\\ &r3(k,i)\times KSTR(k-3,i)\times KTH(k-3,i)-\\ &s0(k,i)\times KACT(k,i)]\end{aligned} \tag{30}$$

Although the detected equivalent ratio KACT in Eqs. (27), (29), and (30) is not detected cylinder by cylinder, the same parameter (k,i) is attached. Further, although the acceleration/deceleration correction coefficient KTH in Eqs. (29) and (30) and the target equivalent ratio KCMD in Eq. (30) are not set corresponding to each cylinder, the same parameter (k,i) is similarly attached. When using the control time n corresponding to the execution period of this process, the following expressions are given.

KACT(k,i)=KACT(n)

KACT(k−3,i)=KACT(n−12)

KTH(k−j,i)=KTH(n−4j) (j=1 to 6)

KCMD(k,i)=KCMD(n)

FIG. 10 is a flowchart showing the AFOFTLS calculation process executed in step S15 shown in FIG. 4.

In step S61, the steady-state correction coefficient AFOFT (k,i) is calculated from Eq. (15). In steps S62 to S66, it is determined whether or not predetermined engine operating condition is satisfied.

More specifically, in step S62, it is determined whether or not the engine coolant temperature TW falls between a predetermined upper limit XTWAOFH (e.g., 90°) and a predetermined lower limit XTWAOFL (e.g., 75°). If the answer to step S62 is affirmative (YES), it is determined whether or not the intake air temperature TA falls between a predetermined upper limit XTAAOFH (e.g., 50°) and a predetermined lower limit XTAAOFL (e.g., 25°) (step S63). If the answer to step S63 is affirmative (YES), it is determined whether or not the engine rotational speed NE falls between a predetermined upper limit XNEAOFH (e.g., 3000 rpm) and a predetermined lower limit XNEAOFL (e.g., 1500 rpm) (step S64). If the answer to step S64 is affirmative (YES), it is determined whether or not the absolute intake pressure PBA falls between a predetermined upper limit XPBAOFH (e.g., 73 kPa (550 mmHg)) and a predetermined lower limit XPBAOFL (e.g., 47 kPa (350 mmHg)) (step S65). If the answer to step S65 is affirmative (YES), it is determined whether or not the vehicle speed VP falls between a predetermined upper limit XVPAOFH (e.g., 80 km/h) and a predetermined lower limit XVPAOFL (e.g., 40 km/h) (step S66).

If the answer to step S66 is affirmative (YES), which indicates that the predetermined engine operating condition is satisfied, the air-fuel ratio deviation AFOFTLS(k,i) is calculated in step S68 and S69. Further, the gain parameter Q(k+1) to be used in calculating the gain coefficient KQ during the execution of this process corresponding to the control time (k+1) (the execution of one combustion cycle after) is calculated (step S70). That is, in step S68, the gain coefficient KQ(k,i) is calculated from Eq. (17). In step S69, the air-fuel ratio deviation AFOFTLS(k,i) is calculated from Eq. (16). In step S70, the gain parameter Q(k+1) is calculated from Eq. (18).

If the answer to any one of the steps S62 to S66 is negative (NO), which indicates that the predetermined engine operating condition is not satisfied, the air-fuel ratio deviation AFOFTLS(k,i) and the gain parameter Q(k+1) are respectively set to the preceding values AFOFTLS(k−1,i) and Q(k) calculated in the execution of this process one combustion cycle before (step S67).

FIG. 11 is a flowchart showing an example determination process executed in step S16 shown in FIG. 4. This process determines a degree of the air-fuel ratio differences between cylinders.

In step S81, the average AFOFTAVE is calculated from Eq. (19). In step S82, a deviation DAFOFT(i) (i=0 to 3) corresponding to each of the four cylinders is calculated from Eq. (31) shown below.

$$DAFOFT(i)=|AFOFTLS(k,i)-AFOFTAVE| \tag{31}$$

In step S83, it is determined whether or not the deviation DAFOFT(0) is less than a predetermined determination threshold AFOFTLMT (e.g., 0.1). If the answer to step S83 is affirmative (YES), it is determined whether or not the deviation DAFOFT(1) is less than the predetermined determination threshold AFOFTLMT (step S84). If the answer to step S84 is affirmative (YES), it is determined whether or not the deviation DAFOFT(2) is less than the predetermined determination threshold AFOFTLMT (step S85). If the answer to step S85 is affirmative (YES), it is determined whether or not the deviation DAFOFT(3) is less than the predetermined determination threshold AFOFTLMT (step S86).

If the answer to step S86 is affirmative (YES), which indicates that all of the deviations DAFOFT(0), DAFOFT (1), DAFOFT(2), and DADOFT(3) are less than the predetermined determination threshold AFOFILMT, it is determined that a degree of the air-fuel ratio differences between cylinders are small (normal). Conversely, if the answer to any one of the steps S83 to S86 is negative (NO), it is determined that the air-fuel ratio deviation in the corresponding cylinder is large (abnormal), and an abnormality flag FAFOFT is set to "1" (step S87). The abnormality flag FAFOFT is set to "0" in the initial condition. When the abnormality flag FAFOFT is set to "1", indicia of a warning is given such as a warning lamp is turned on.

According to tag embodiment described above, the model parameter vector θ is identified corresponding to each cylinder of the engine 1 by the identifier 42 included in the self-tuning regulator 31, and a degree of the air-fuel ratio differences between cylinders are determined according to the model parameter identified above. Accordingly, the degree of the air-fuel ratio differences between cylinders can be determined relatively simply without providing an air-fuel ratio sensor for each cylinder, or performing the computation corresponding to the observer as in the prior art.

Further, it may be determined whether or not the predetermined engine operating condition is satisfied in steps S62 to S66 shown in FIG. 10, and a degree of the air-fuel ratio differences between cylinders are determined according to the model parameter vector θ identified when the predetermined engine operating condition is satisfied. Accordingly, the determination can be accurately performed according to the model parameters identified when the engine operation is stable.

Further, the steady-state correction coefficient AFOFT as the air-fuel ratio difference evaluating parameter is calculated according to the model parameter vector θ, and the determination of a degree of the air-fuel ratio differences is performed according to the air-fuel ratio deviation AFOFTLS obtained by the statistical process of the steady-state correction coefficient AFOFT calculated above. Although the identified model parameter vector θ indicates variations or fluctuations, the influence of such variations or fluctuations can be eliminated by performing the determination according to the value obtained by the statistical process, thereby achieving accurate determination. Moreover, since the above-mentioned statistical process is performed by the sequential least square method algorithm, it is not necessary to execute the inverse matrix operation and store massive data, to thereby reduce the calculation load on the CPU in the ECU 5.

In a preferred embodiment, the ECU 5 constitutes the identifying means and the air-fuel ratio difference determining means. More specifically, the steps S54 and S55 in FIG. 9 correspond to the identifying means, and the processes of FIGS. 10 and 11 correspond to the air-fuel ratio difference determining means.

The present invention is not limited to the above embodiments, but various modifications may be made. For example, in the above embodiment, the statistical process of the steady-state correction coefficient AFOFT is performed by the sequential least square method algorithm. This algorithm may be replaced by the batch operation to be performed at the time a predetermined number of data are measured.

Further, in the above embodiments, the self-tuning correction coefficient KSTR corresponds to the fuel supply amount parameter that specifies a fuel supply amount for each cylinder of the engine. Alternatively, a required fuel injection amount TCYL'(=TIM×KSTR) may be used instead of the self-tuning correction coefficient KSTR as the fuel supply amount parameter.

Further, as previously described, the controlled object model is defined by Eq. (2) including the acceleration/deceleration correction coefficient KTH. The above-mentioned method for determining a degree of the air-fuel ratio differences between cylinders may be applied also to the case where the controlled object model is defined by Eq. (2a) shown below. Eq. (2a) does not include the acceleration/deceleration correction coefficient KTH. That is, the method according to the present invention for determining a degree of the air-fuel ratio differences between cylinders is applicable also to a controlled object model defined by the relation between a parameter (KACT) indicative of an air-fuel ratio detected by an air-fuel ratio sensor and a parameter (e.g., KSTR) specifying a fuel supply amount for each cylinder of the engine 1.

$$KACT(k) = b0 \times KSTR(k-3) + r1 \times KSTR(k-4) + r2 \times KSTR(k-5) + r3 \times KSTR(k-6) + s0 \times KACT(k-3) \quad (2a)$$

Further, the present invention is applicable also to the control of a watercraft propulsion engine such as an outboard engine having a vertically extending crankshaft.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. An air-fuel ratio control apparatus for controlling an air-fuel ratio of an air-fuel mixture to be supplied to an internal combustion engine having a plurality of cylinders so that the air-fuel ratio coincides with a target air-fuel ratio, said air-fuel ratio control apparatus comprising:

an air-fuel ratio sensor provided at a position downstream of a joining portion of an exhaust manifold connected to said plurality of cylinders, said air-fuel ratio sensor for detecting an air-fuel ratio in exhaust;

identifying means for identifying at least one model parameter of a controlled object model defined by a relation between the air-fuel ratio detected by said air-fuel ratio sensor and a fuel supply amount parameter that specifies a fuel supply amount to each cylinder of said engine, the at least one model parameter being identified corresponding to each cylinder of said engine; and air-fuel ratio difference determining means for determining a degree of differences between air-fuel ratios of air-fuel mixtures to be supplied to said plurality of cylinders, according to the at least one model parameter identified by said identifying means.

2. An air-fuel ratio control apparatus according to claim 1, wherein said air-fuel ratio difference determining means determines the degree of the differences according to the at least one model parameter identified when a predetermined engine operating condition is satisfied.

3. An air-fuel ratio control apparatus according to claim 1, wherein said air-fuel ratio difference determining means calculates a difference evaluation parameter according to the at least one model parameter and determines the degree of the differences according to a value obtained by a statistical process of the difference evaluation parameter.

4. An air-fuel ratio control apparatus according to claim 3, wherein the statistical process is performed using a sequential algorithm.

5. An air-fuel ratio control apparatus according to claim 1, wherein the fuel supply amount parameter is a correction coefficient of the fuel supply amount to be supplied to each cylinder of said engine.

6. A method for controlling an air-fuel ratio of an air-fuel mixture to be supplied to an internal combustion engine having a plurality of cylinders so that the air-fuel ratio coincides with a target air-fuel ratio, said air-fuel ratio control method comprising the steps of:

a) detecting the air-fuel ratio by an air-fuel ratio sensor provided at a position downstream of a joining portion of an exhaust manifold connected to said plurality of cylinders;

b) identifying at least one model parameter of a controlled object model defined by a relation between the detected air-fuel ratio and a fuel supply amount parameter that specifies a fuel supply amount to each cylinder of said engine, the at least one model parameter being identified corresponding to each cylinder of said engine; and c) determining a degree of differences between air-fuel ratios of air-fuel mixtures to be supplied to said plurality of cylinders, according to the at least one identified model parameter.

7. An air-fuel ratio control method according to claim 6, wherein the degree of the differences is determined according to the at least one model parameter identified when a predetermined engine operating condition is satisfied.

8. An air-fuel ratio control method according to claim 6, wherein a difference evaluation parameter is calculated according to the at least one model parameter and the degree of the differences is determined according to a value obtained by a statistical process performed on the difference evaluation parameter.

9. An air-fuel ratio control method according to claim 8, wherein the statistical process is performed using a sequential algorithm.

10. An air-fuel ratio control method according to claim 6, wherein the fuel supply amount parameter is a correction coefficient of the fuel supply amount to be supplied to each cylinder of said engine.

11. A computer program embodied on a computer readable medium, said computer program for causing a computer to carry out a method for controlling an air-fuel ratio of an air-fuel mixture to be supplied to an internal combustion engine having a plurality of cylinders so that the air-fuel ratio coincides with a target air-fuel ratio, said air-fuel ratio control method comprising the steps of:

a) detecting the air-fuel ratio by an air-fuel ratio sensor provided at a position downstream of a joining portion of an exhaust manifold connected to said plurality of cylinders;

b) identifying at least one model parameter of a controlled object model defined by a relation between the detected air-fuel ratio and a fuel supply amount parameter that specifies a fuel supply amount to each cylinder of said engine, the at least one model parameter being identified corresponding to each cylinder of said engine; and c) determining a degree of differences between air-fuel ratios of air-fuel mixtures to be supplied to said plurality of cylinders, according to the at least one identified model parameter.

12. A computer program according to claim 11, wherein the degree of the differences is determined according to the at least one model parameter identified when a predetermined engine operating condition is satisfied.

13. A computer program according to claim 11, wherein a difference evaluation parameter is calculated according to the at least one model parameter and the degree of the differences is determined according to a value obtained by a statistical process performed on the difference evaluation parameter.

14. A computer program according to claim 13, wherein the statistical process is performed using a sequential algorithm.

15. A computer program according to claim 11, wherein the fuel supply amount parameter is a correction coefficient of the fuel supply amount to be supplied to each cylinder of said engine.

16. A motorized vehicle comprising:

an internal combustion engine having a plurality of cylinders;

an exhaust manifold connected to the plurality of cylinders; and an air-fuel ratio control apparatus configured to control an air-fuel ratio of an air-fuel mixture to be supplied to the internal combusion engine so that the air-fuel ratio coincides with a target air-fuel ratio, said air-fuel ratio control apparatus comprising:

an air-fuel ratio sensor provided at a position downstream a joining portion where the exhaust manifold is connected to the plurality of cylinders, said air-fuel ratio sensor for detecting an air-fuel ratio of exhaust;

identifying means for identifying at least one model parameter of a controlled object model defined by a relation between the air-fuel ratio detected by said air-fuel ratio sensor and a fuel supply amount parameter that specifies a fuel supply amount to each cylinder of said engine, the at least one model parameter being identified corresponding to each cylinder of said engine; and air-fuel ratio difference determining means for determining a degree of differences between air-fuel ratios of air-fuel mixtures to be supplied to said plurality of cylinders, according to the at least one model parameter identified by said identifying means.

* * * * *